United States Patent [19]

Everard et al.

[11] 4,172,301

[45] Oct. 30, 1979

[54] FLUID FILLED BEDS AND THE LIKE

[75] Inventors: Lloyd D. Everard, Kent, Wash.; Carlos A. Mollura, 2824 Del Oro Pl., Fullerton, Calif. 92635

[73] Assignee: Carlos A. Mollura, City of Industry, Calif.

[21] Appl. No.: 865,995

[22] Filed: Dec. 30, 1977

[51] Int. Cl.[2] ..... A47C 4/54; B32B 31/04

[52] U.S. Cl. ..... 5/456; 5/455; 156/290

[58] Field of Search ..... 5/349, 350, 365–369; 297/DIG. 8, 252; 156/290

[56] References Cited

U.S. PATENT DOCUMENTS

| | | | |
|---|---|---|---|
| 3,766,579 | 10/1973 | Shields | 5/370 |
| 3,879,776 | 4/1975 | Solen | 5/350 |
| 4,056,858 | 11/1977 | Weber | 5/365 |

OTHER PUBLICATIONS p. 81, Industry Magazine, Mollura Industries, May 1978.

*Primary Examiner*—Casmir A. Nunberg
*Attorney, Agent, or Firm*—Flam & Flam

[57] ABSTRACT

Apparatus and method are disclosed which pertain to inflatable structures useful as air beds and the like. Shape and load control are facilitated by a plurality of bladders that are located within an inflatable chamber of the structure and are joined to opposed imperforate walls thereof. The bladders are provided with vents which lend to the interior of the chamber, and upon inflation of the structure and resultant separation of the opposed walls of the chamber, the bladders are caused to extend from a flattened state, become filled with the fluid used for inflating the structure, and assume a roughly cylindrical convoluted configuration. Being made of a flexible, substantially non-extensible material, such a vinyl plastics, there is a limit to which the bladders can extend, and further vertical separation or lateral shifting of the attached opposed walls is thereby restrained. When the bladders are provided with vents, they "breathe" when a physical load is applied to the inflated structure or removed from it, hence, regulating resiliency by means of an "air spring" effect.

9 Claims, 9 Drawing Figures

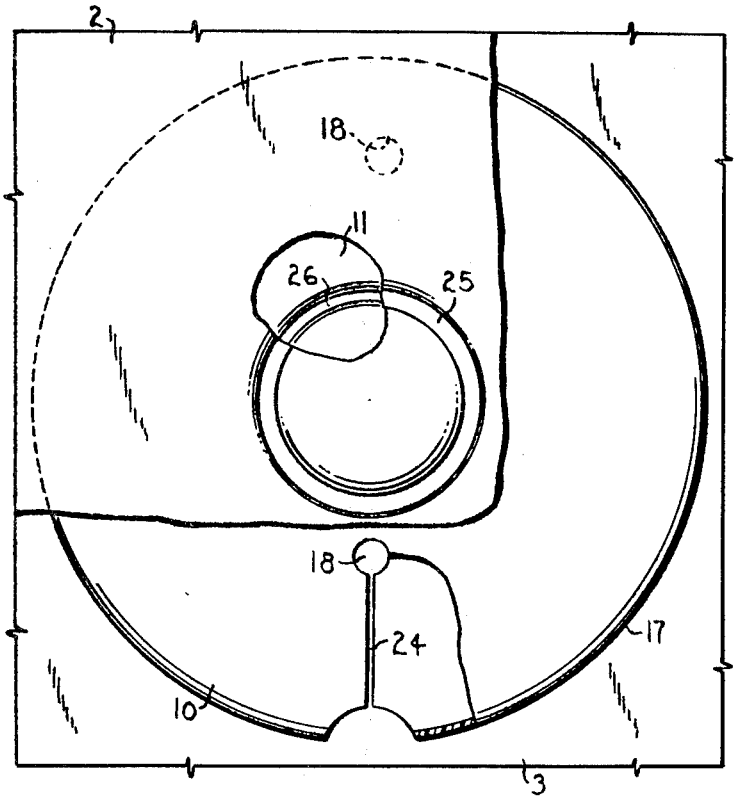
Fig. 6.
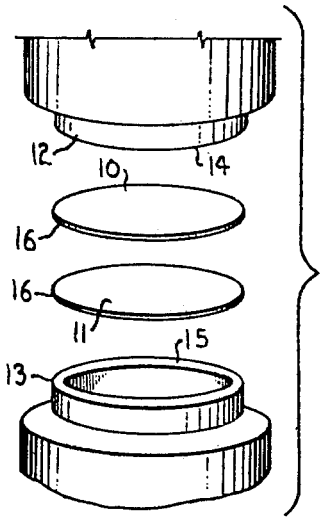
Fig. 5.
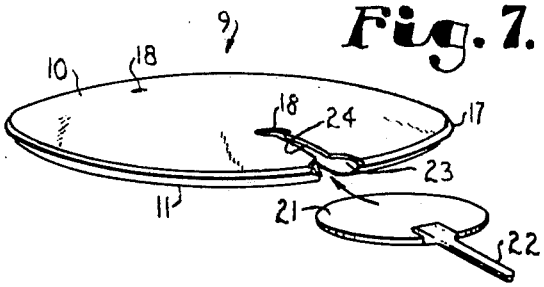
Fig. 7.
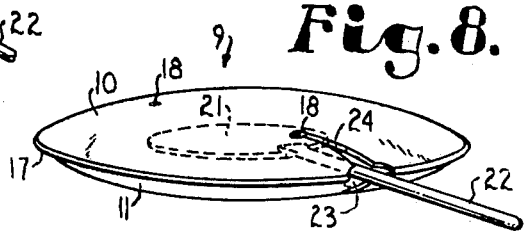
Fig. 8.
Fig. 9.
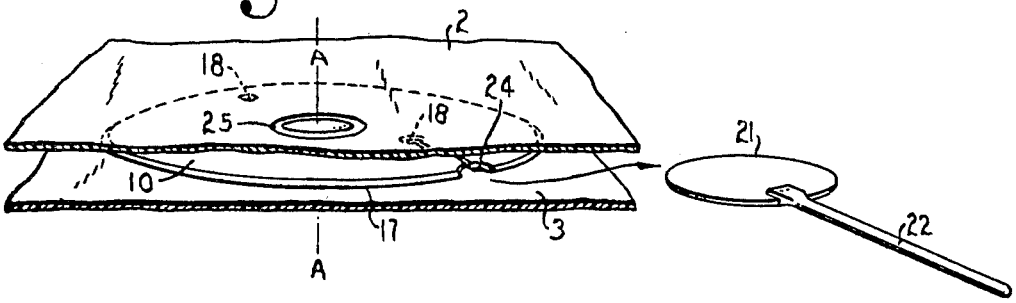

FLUID FILLED BEDS AND THE LIKE

BACKGROUND OF THE INVENTION

The present invention pertains to inflatable structures and more particularly to load supporting structures where the function is to provide a measure of resiliency or a spring effect. According, the present invention can be used to advantage in the construction of air or water beds to control the shape and resiliency thereof.

Air beds and water beds have been marketed with various types of connections between the top and bottom sheets that function as the springs or ties used in conventional bedsprings or mattresses. Exemplary connections or ties between imperforate upper and lower plastic walls of prior fluid-filled beds include inflatable cylinders or beams as shown in Nail's U.S. Pat. No. 3,705,429, and zig-zag sheets as shown in Melzer's U.S. Pat. No. 2,703,770. The cylinders and beams disclosed by Nail serve as ties between the top and bottom sheets of the structure, but are molded to a generally cylindrical or rectangular shape and, as such, cannot readily assume a smoothly flattened configuration when the structure is deflated, thus hindering the collapse thereof to a neatly folded configuration having minimum volume. This problem is overcome to some extent by use of one or more ties in the form of zig-zag sheets between the upper and lower sheets as is shown by Melzer, but this increases the cost of materials, construction is more complex, and there is limited choice of the pattern of "tufting" that can be provided. In addition, the walls of the air cavities in Melzer's structure are interconnected with each other, as are the air cavities themselves, and shape and load control functions are not equivalent to those provided by use of individual, free-standing pockets located within an outer inflatable chamber. Smoothly flattened bladder configurations are known to have been used in connection with inflatable toys and the like, but they included undesirable perforated top and/or bottom walls, permitting air to freely enter the bladder from the outside of the device.

SUMMARY OF THE INVENTION

A primary object of the present invention is, therefore, to overcome the aforementioned problems and disadvantages associated with prior inflatable structures.

One particular object is to provide an inflatable structure with imperforate top and bottom walls having improved provisions for shape and load control upon inflation, but which can be totally collapsed and thus fully flattened upon deflation.

Another object is to provide an easily constructed inflatable structure such as an air bed or water bed, having an inflatable chamber with imperforate outer walls that are tied together by means of a plurality of independent bladders that are in a flattened state when the structure is deflated, and which assume a generally cylindrical shape when the structure is inflated.

Still another object is to provide such an inflatable structure having "pancake" bladders therein which become extended for shape and load control of the structure when it is inflated, and which flatten out like pancakes when the structure is deflated.

Other objects and advantages of the present invention will become apparent from the following description, the drawings and the appended claims.

According to the invention, an inflatable structure is provided which comprises an inflatable chamber with opposed imperforate walls formed of substantially non-expansible air impervious material and which are progressively separable by continued inflation of the chamber. A bladder formed of a flexible substantially non-expansible material is located within the chamber and is joined to both of the opposed walls thereof on a bladder axis. The bladder is axially extensible from a flattened state and is convolutedly inwardly collapsable toward the axis upon progressive separation of the opposed walls of the chamber. A plurality of such bladders, spaced apart from each other, can be employed in inflatable structures intended for use as air or water beds.

The presently disclosed inflatable structure thus comprises an improvement for tying the opposed imperforate walls of the inflatable structure together and, when desired, for controlling resiliency of the structure. Fabrication of the structure includes the step of confrontingly aligning two sheet members of a flexible substantially non-expansible material, joining the perimeters of the sheet members together, and thereby forming a flat "pancake" bladder. The bladder thus formed is thereafter placed between the opposed walls of the inflatable chamber of the structure and is aligned so that each sheet member thereof confronts one of the opposed walls. Each of the opposed walls of the inflatable chamber is then joined to the sheet member of the bladder that confronts it, and with the joint therebetween being located inwardly of the perimeter of the sheet member.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

FIG. 5 is a perspective view illustrating sealing of the perimeters of the two confrontingly aligned sheet members of the "pancake" bladder shown in the drawings.

FIG. 6 is a somewhat enlarged downward view, partly in section, of the flattened "pancake" bladder located between the upper and lower opposed walls of the air bed shown in FIGS. 1–4.

FIGS. 7 and 8 are perspective views of the "pancake" bladder following perimetric sealing and perforation of the sheet members thereof, and further illustrating insertion of a heat insulating paddle into the bladder prior to ring sealing of the sheet members to the opposed walls of the air bed.

FIG. 9 is a somewhat enlarged perspective view showing sections of the upper and lower opposed walls of the air bed of FIGS. 1–4 and a deflated "pancake"

bladder therebetween, just after sealing of the sheet members of the bladder to the walls and subsequent to removal of the heat insulating paddle from the cavity of the bladder.

DETAILED DESCRIPTION OF PREFERRED EMBODIMENT

The following detailed description is of the best presently contemplated mode of carrying out the invention. This description is not to be taken in a limiting sense, but is made merely for purposes of illustrating the general principles of the invention since the scope of the invention is best defined by the appended claims.

The term "inflatable structure" as used herein is intended to mean any structure that is inflated by means of a suitable fluid such as air or water, and is intended to include air beds, air mattresses, water beds, inflatable cushions, pillows or furniture, and also such structures as inflatable watercraft, aircraft, chutes, slides, toys and the like.

The opposed walls of the inflatable chamber of the present structure are formed from a flexible, substantially non-expansible air impervious material auch as a thermoplastic resin. The term "substantially non-expansible material" as used herein is intended to mean a material that has a relatively limited degree of stretch with respect to that exhibited by a non-reinforced rubber. Examples of euch materials include thermoplastic polymeric substances that are strong, yet flexible at room temperatures, and a preferred thermoplastic material for construction of the present structures can be selected from commercially available polyvinyl chloride compounds.

Figure 1:
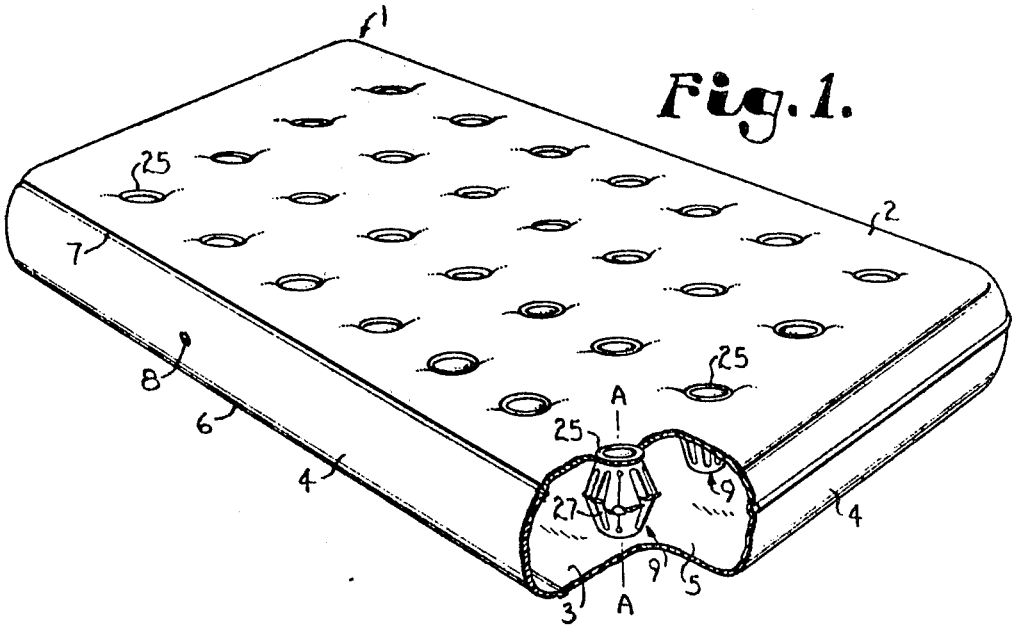
FIG. 1 is a perspective view, partly in section, of an air bed constructed in accordance with the present invention.

In FIG. 1, an inflatable structure is represented at 1, and comprises an inperforate upper wall 2, and an opposed perforate lower wall 3, which along with sidewalls 4, enclose an air chamber 5. The upper and lower walls are thermally bonded to the side-wall seams 6 and 7, and a conventional air valve or valves 8, are installed in a wall or walls as means for injecting air or water into the chamber 5, and for the subsequent emptying thereof. Bladders constructed in accordance with the present invention are represented at 9.

As previously indicated, the upper and lower walls 2 and 3 are made of a flexible, substantially non-expansible air impervious material, such as polyvinyl chloride, and the same type of material can be used for constructing the sidewall 4 and the bladders 9. It will be understood, however, that different materials can be used for the upper and lower walls 2 and 3, the sidewall, and the bladders when such is preferred.

Referring to FIG. 5, in this example, each of the bladders 9 is formed from two circular sheet members 10 and 11, which have been punched or otherwise cut from an elongated sheet of thermoplastic resin. Thereafter, the two circular members are confrontingly aligned, one over the other, and placed between two heated rings 12 and 13 for sealing of the edges of the members by displacing the rings toward each other so that the edges of the sheet members 10 and 11 are pressed together between the heated ring surfaces 14 and 15. Softening of the plastic all the way around the perimeter 15 of each circular sheet member is thereby effected, and there is a welding or fusion of the softened plastic which results in the joining of the two members at their perimeters to form a seam 17 (FIGS. 2, 3, 7 and 9), but there is no fusion and joining of the plastic sheet members 10 and 11 inwardly of this seam. A flat "pancake" bladder comprising the peripherally joined circular sheet members is thereafter recovered, and is subsequently installed between the upper and lower opposed walls 2 and 3 of the air bed 1. Other methods of forming the bladder 9 may utilize a pair of overlying sheets which are fused together in multiple, spaced ring patterns and the patterns are cut out just outside the fused ring.

Figure 2:
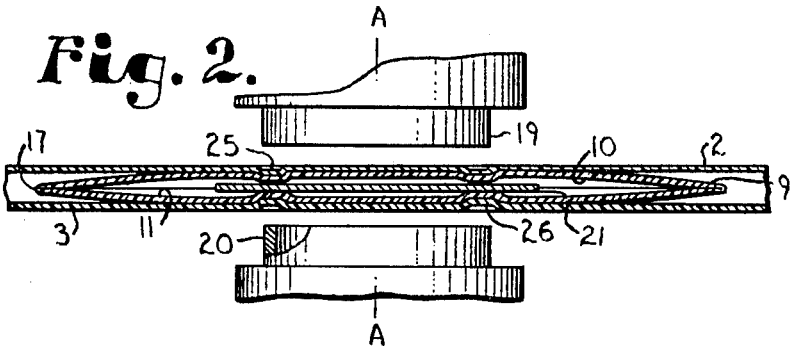
FIG. 2 is a somewhat enlarged elevational view, in section, of the air bed of FIG. 1, and illustrates the air bed while deflated and during an assembly step wherein one of the deflated "pancake" bladders is being joined to the opposed walls of the inflatable chamber of the air bed by sealing with a heated ring.

The bladders are provided with venting means so that they can become filled with the fluid injected into the chamber 5 during inflation of the structure. Accordingly, one or both of the sheet members 10 and 11 can be perforated to provide one or more openings 18, therein before or after forming the perimetric seam 17 of the bladder. After forming the openings 18, the bladder can be attached to the upper and lower walls of the air bed by thermal sealing in a manner similar to that employed for perimetric sealing of sheet members 10 and 11. Refering to FIG. 2, the flat, "pancake" bladder 9 is inserted between the upper and lower walls 2 and 3 of the structure for joining of these walls with the bladder by heat sealing through use of heated rings 19 and 20. An insulating member is emplaced within the bladder, and thus between the sheet members thereof, to prevent heat sealing of the sheet members to each other during the sealing thereof to the outer walls of the structure. As shown in FIGS. 7 and 8, the insulating member can be in the form of a metal plate 21, and can be equipped with a handle 22, or other appropriate handling means, to facilitate insertion of the plate into the bladder cavity 23 and subsequent removal therefrom. Accordingly, the bladder 9 can be provided with a slit 24 in its wall to permit insertion and removal of the plate 21, and it will be appreciated that the handle 22 also serves as an aid in properly locating the plate 21 with respect to the bladder and the heat rings 19 and 20 when the bladder is placed between the walls 2 and 3 for sealing thereto. Once a bladder 9 and an emplaced plate 21 have been positioned in a desired location between the opposed walls 2 and 3, and the bladder and the walls have been placed between the heated rings 19 and 20 with the bladder centered with respect thereto, the heated rings are then brought toward each other to compress the bladder sheet members 10 and 11 against the walls 2 and 3 to effect the joining thereof. Accordingly, sufficient heat and pressure are applied by means of the heat rings to effect welding or fusion of the thermoplastic walls of the bladder and the walls 2 and 3, and this results in formation of ring seals 23 and 26 at the sites where the fusion occurs. Once the formation of the ring seals is completed, the heat rings 19 and 20 are separated from each other as shown in FIG. 2, and plate 21 is withdrawn from the bladder through slit 24, as shown in FIG. 9. Thereafter, other like bladders are sealed to walls 2 and 3 in the same fashion as previously described. The foregoing provides a manufacturing method which is relatively simple, reliable and inexpensive.

As previously indicated, the bladders 9 are aligned on a bladder axis which is generally perpendicular to the opposed walls 2 and 3 of the inflatable structure. Such an axis is illustrated by line A—A in the drawings. A plurality of bladders can be aligned on an equivalent number of axes arranged in any convenient pattern to provide various air spring effects or "turfing" patterns as may be desired. FIGS. 2, 6 and 9 illustrate the "pancake" bladder 9 in a flattened state, i.e. the configuration of the bladder when the structure 1 is deflated.

Figure 3:
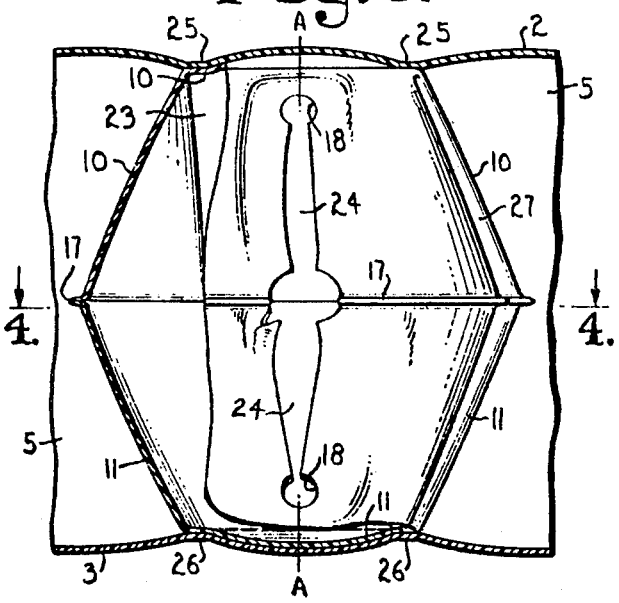
FIG. 3 is a somewhat enlarged elevational view, in section, of the air bed of FIG. 1, and illustrates the "pancake" bladder in an extended, cylindrically convoluted state, following inflation of the air bed.
Figure 4:
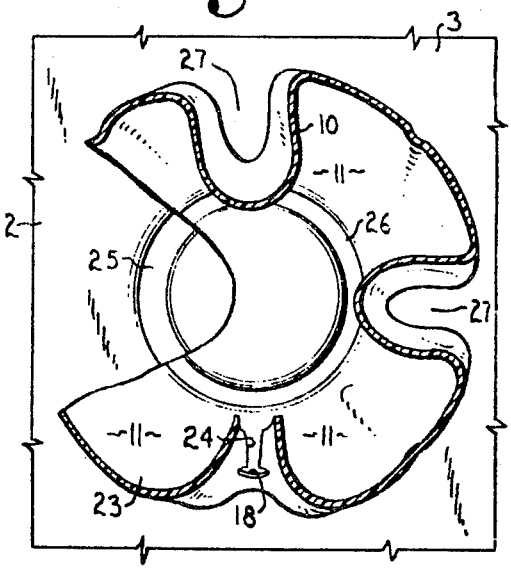
FIG. 4 is a downward view of the structure shown in FIG. 3.

FIGS. 1, 3 and 4 illustrate the bladder in an extended, convolutedly inwardly collapsed state following inflation of the air bed by injection of a fluid into the inflatable chamber 5. As can been seen from the drawings, the bladders are axially extensible from the flattened state and convolutedly inwardly collapsable toward the aixs A—A upon progressive separation of the opposed walls 2 and 3 of chamber 5 during the inflation thereof. More specifically, as the walls 2 and 3 move apart from each other during inflation of the air bed, the bladder sheet members 10 and 11 are caused to move apart from each other in opposite directions along the axis A—A, thereby forming a bladder cavity 23 between the sheet members which fills with the fluid being sucked into chamber 5 through the openings 18 and slit 24. As further separation of the walls 2 and 3 occurs by continued inflation of chamber 5, the sheet members 10 and 11 assume a biconical configuration in alignment with axis A—A, and eventually the sheets partially collapse inwardly toward the axis to form convolute folds 27. When this convolutedly inward collapse of the bladder members has progressed to the maximum degree, the bladder is essentially no longer axially extensible, and it thereby restrains further separation of the opposed walls 2 and 3.

Each of the bladders 9, therefore, has an axial extension limit equivalent to a maximum desired separation distance between the opposed walls 2 and 3 when the air bed has been fully inflated. This axial extension limit is established by constructing the bladder so that the difference between the diameter of each of the sheet members 10 and 11 and that of its respective ring seal 25 or 26 is approximately one-half of the desired separation distance between the opposed walls 2 and 3 when chamber 5 has been fully inflated. The seal rings 25 and 26 can, nonetheless, have any diameter selected to provide both satisfactory strength of attachment to the walls 2 and 3 and a desired appearance for esthetic purposes. Where preferred, the attachment of the bladders to walls 2 and 3 can have other than a ring or circular configuration, and regardless of the shape, size and nature of the joint between the bladders and the opposed walls, the maximum separation distance between the walls can be increased by use of bladder sheet members 10 and 11 of a larger diameter, and can be decreased by use of sheet members having a smaller diameter. More specifically, the extension limit of the bladders can be increased or decreased by selectively increasing or decreasing the sheet members 10 and 11.

As shown in the drawings, each of the bladders 9 is provided with venting means, e.g. openings 18 and the slit 24 functions as venting means whereby the bladder cavity 23 becomes filled with the fluid injected into chamber 5 of the structure 1 during the inflation thereof, but it will be understood when a bladder is thus filled, it nonetheless provides an "air spring" effect even though fluid is partially ejected from its cavity back into the chamber 5 when a load is placed on the air bed and causes it to become compressed. Such occurs as a result of the fluid in chamber 5 being under pressure, hence causing a retarded discharge of fluid from the bladder cavity. In a similar fashion, the cavity does not immediately refill after a compressive load is removed from the air bed, and the bladders thus "breathe" upon application and release of pressure on the structure 1. It will be appreciated that the rate at which the bladders breathe is dependent upon the number and size of openings such as 18 and 24, and that both the number and size of the openings is subject to variation depending on the degree of resiliency and load control desired.

As shown in FIGS. 1, 3 and 4, the structure 1 is shown to be inflated with the bladders 9 extended along axis A—A to their maximum limit, and whereby the bladders have assumed a convoluted cylindrical configuration. Accordingly, the opposed walls 2 and 3 are restrained by the extended bladders from further separating from each other, which also being restrained to a considerable degree from lateral displacement. Shape control is thus provided by the bladders, and an "air spring" effect for load control is also provided when the bladders are suitably adapted to provide such an effect.

It should be re-emphasized out that the present bladder construction is particularly advantageous from the standpoint of ease of manufacture as well as convenient storage, i.e. upon discharging the fluid from chamber 5, the bladders return to a flat "pancake" configuration as shown in FIG. 2 so that the entire deflated structure becomes quite flat for folding and rolling into a volume approaching the smallest possible size.

An inflatable structure that fulfills the previously stated objects has now been described in detail, and since the description has not included details on all conceivable embodiments thereof, it will be understood that other embodiments will become apparent which are within the spirit and scope of the invention defined in the following claims.

Intending to claim all novel, useful and unobvious features shown or described, we make the following claims:

1. An inflatable structure comprising an inflatable chamber with opposed imperforate walls formed of a flexible substantially non-expansible air impervious material and which are progressively separate by continued inflation of said chamber, an independent bladder that is located within said chamber and formed of a flexible substantially non-expansible material, spaced parts of said bladder being respectively joined to said opposed walls on a bladder axis and being axially extensible from a flattened state and convolutedly inwardly collapsible toward said axis upon progressive separation of said opposed walls, said bladders permitting said opposed walls to separate and to be spaced from each other throughout substantially the entire area of said opposed walls.

2. An inflatable structure as in claim 1 comprising a plurality of said bladders at spaced intervals within said inflatable chamber.

3. An inflatable structure as in claim 1 and further comprising venting means for flow of fluid between the interior of said bladder and said inflatable chamber.

4. An inflatable structure as in claim 1 wherein said bladder has an established axial extension limit equivalent to a desired maximum separation distance between said opposed walls.

5. An inflatable structure as in claim 1 wherein said opposed walls of the structure and said sheet members of the bladder are formed from a fusible polymeric material and are joined by heat sealing.

6. A fluid mattress structure comprising:

(a) opposed wall sections made of flexible plastic sheet material, one of said walls being designed to contact a support and the other of said walls being designed to support a person;

(b) a plurality of independent bags located between the layers and each made of flexible plastic sheet material each of said bags being attached at opposite ends to the wall sections respectively while maintaining the fluid retaining integrity of the mattress;

(c) said bags allowing said opposed wall sections to separate and to be spaced from each other throughout substantially the entire operative area of said mattress.

7. An inflatable structure comprising:

(a) an inflatable chamber with opposed imperforate walls formed of flexible substantially non-expansible, air impervious material and which are progressively separable by continued inflation of said chamber;

(b) a bladder that is located within said chamber and formed of flexible substantially non-expansible material;

(c) spaced parts of said bladder being respectively joined to said opposed walls on a bladder axis, said bladder being axially extensible from a flattened state to an inwardly collapsed convoluted state toward said axis upon progressive separation of said opposed walls;

(d) said bladder comprising two sheet members each of which is joined inwardly from the perimeter thereof with one of said opposed walls of the inflatable chamber, said sheet members being joined at their perimeters and each being axially extensible in opposite directions while being convoluted and inwardly collapsible toward said axis upon separation of said opposed walls of said chamber.

8. The inflatable structure as set forth in claim 14 in which said bladder is open for free flow of fluid between the interior of the bladder and the interior of said inflatable chamber.

9. A fluid mattress structure comprising:

(a) opposed wall sections made of flexible plastic sheet material, one of said walls being designed to contact a support, and the other of said walls being designed to support a person;

(b) a plurality of independent bags located between the layers and each made of flexible plastic sheet material each of said bags being attached at opposite ends to the wall sections, respectively, while maintaining the fluid retaining integrity of the mattress;

(c) each of said bags comprising a pair of layers of plastic sheet material of substantially corresponding size and configuration peripherally attached together;

(d) the central portions of the respective bag layers being attached to said wall sections at places spaced inwardly of the periphery of the bag so that the bag distends and contracts as the wall sections separate and approach each other;

(e) the bags having one or more lateral openings for free flow of fluid between the interior of the bag and the interior of the mattress.

* * * * *